US010626483B2

(12) United States Patent
Sekiya et al.

(10) Patent No.: US 10,626,483 B2
(45) Date of Patent: Apr. 21, 2020

(54) COPPER ALLOY WIRE ROD

(71) Applicant: Furukawa Electric Co., Ltd., Tokyo (JP)

(72) Inventors: Shigeki Sekiya, Tokyo (JP); Hidemichi Fujiwara, Tokyo (JP); Kengo Mitose, Tokyo (JP)

(73) Assignee: Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 16/046,673

(22) Filed: Jul. 26, 2018

(65) Prior Publication Data

US 2018/0371580 A1 Dec. 27, 2018

Related U.S. Application Data

(63) Continuation of application No. PCT/JP2017/018185, filed on May 15, 2017.

(30) Foreign Application Priority Data

May 16, 2016 (JP) ..... 2016-097987

(51) Int. Cl.
*C22C 9/00* (2006.01)
*H01B 1/02* (2006.01)
(Continued)

(52) U.S. Cl.
CPC ..... *C22C 9/00* (2013.01); *B21C 1/003* (2013.01); *C22F 1/08* (2013.01); *H01B 1/02* (2013.01); *H01B 1/026* (2013.01)

(58) Field of Classification Search
CPC ..... B21C 1/003; C22F 1/08; H01B 1/026; H01B 5/02; H01B 5/04
See application file for complete search history.

(56) References Cited

U.S. PATENT DOCUMENTS

2005/0260438 A1 11/2005 Aoyagi et al.
2013/0028784 A1* 1/2013 Takahashi ..... C22C 9/06 420/471

(Continued)

FOREIGN PATENT DOCUMENTS

CN 102859016 A 1/2013
CN 102869805 A 1/2013

(Continued)

OTHER PUBLICATIONS

Decision to Grant a Patent received for JP Application No. 2017-5452971, dated Jan. 15, 2018.

(Continued)

*Primary Examiner* — Vanessa T. Luk
(74) *Attorney, Agent, or Firm* — Dorsey & Whitney LLP

(57) ABSTRACT

A copper alloy wire rod has a chemical composition comprising Ag: 0.1 to 6.0 mass % and P: 0 to 20 mass ppm, the balance being copper with inevitable impurities. In a cross section parallel to a longitudinal direction of the wire rod, a number density of second phase particles each having an aspect ratio of greater than or equal to 1.5 and a size in a direction perpendicular to the longitudinal direction of the wire rod of less than or equal to 200 nm is greater than or equal to 1.4 particles/$\mu m^2$.

5 Claims, 3 Drawing Sheets

(51) Int. Cl.
*C22F 1/08* (2006.01)
*B21C 1/00* (2006.01)

(56) References Cited

U.S. PATENT DOCUMENTS

| | | | | |
|---|---|---|---|---|
| 2014/0205492 | A1* | 7/2014 | Inoue | B22D 7/005 420/492 |
| 2017/0253954 | A1 | 9/2017 | Yoshida et al. | |

FOREIGN PATENT DOCUMENTS

| | | | | |
|---|---|---|---|---|
| CN | 103827330 | A | 5/2014 | |
| CN | 104169447 | A | 11/2014 | |
| CN | 104169448 | A | 11/2014 | |
| CN | 105518165 | A | 4/2016 | |
| EP | 2868757 | A1 | 5/2015 | |
| EP | 2868758 | A1 | 5/2015 | |
| EP | 2873475 | A1 | 5/2015 | |
| EP | 3042972 | A1 | 7/2016 | |
| EP | 3228719 | A1 | 10/2017 | |
| JP | H02270945 | A | 11/1990 | |
| JP | 2000199042 | A | 7/2000 | |
| JP | 2002241872 | A | 8/2002 | |
| JP | 2004190047 | A | 7/2004 | |
| JP | 2008081834 | A | 4/2008 | |
| JP | 2008248275 | A | 10/2008 | |
| JP | 2009280860 | A | 12/2009 | |
| JP | 2011146352 | A | 7/2011 | |
| JP | 2011246802 | A | 12/2011 | |
| JP | 4971856 | B2 | 4/2012 | |
| JP | 5195019 | B2 | 2/2013 | |
| JP | 2015021138 | A | 2/2015 | |
| JP | 5713230 | B2 | 3/2015 | |
| JP | 2017002337 | A | 1/2017 | |
| WO | WO-2011125264 | A1 * | 10/2011 | C22C 9/06 |
| WO | WO-2013047276 | A1 * | 4/2013 | |
| WO | 2014007258 | A1 | 1/2014 | |

OTHER PUBLICATIONS

English Translation of International Preliminary Report on Patentability Chapter I in PCT Application No. PCT/JP2017/018185 (WO2017/199906), dated Nov. 20, 2018.

English Translation of the Written Opinion of the International Search Authority in PCT Application No. PCT/JP2017/018185 (WO2017/199906), dated Jul. 25, 2017.

Decision to Grant a Patent received for JP Application No. 2017-54597, dated Jan. 15, 2018.

International Search Report and Written Opinion received for PCT Application No. PCT/JP2017/018185, dated Jul. 25, 2017 (Engl. translation of ISR only).

English translation of Office Action for CN Application No. 201780004396.9, dated Oct. 24, 2019.

Chi, Lan , "Research on Pure Copper Wires and Copper-Base Materials with High Strength and High", Chinese Journal of Rare Metals, vol. 28, No. 5, Oct. 2004 (pp. 917-920).

Xie, Jianxin et al., "Preparation and Processing Technology of High-Performance Copper Alloy Wires", Chinese Materials Symposium, Oct. 2000, (pp. 1319-1324).

English translation of KR Office Action for Application No. 10-2018-7015960, dated Nov. 22, 2019.

Extended European Search Report for Application No. 17799330.0, dated Dec. 10, 2019.

* cited by examiner

COPPER ALLOY WIRE ROD

CROSS REFERENCE TO RELATED APPLICATIONS

This is a continuation application of International Patent Application No. PCT/JP2017/018185 filed May 15, 2017, which claims the benefit of Japanese Patent Application No. 2016-097987, filed May 16, 2016, the full contents of both of which are hereby incorporated by reference in their entirety.

BACKGROUND

Technical Field

The present disclosure relates to a copper alloy wire rod that can be favorably used for wire rods for micro speakers or magnet wires or used for ultra-fine coaxial cables, for which a high tensile strength, a high flexibility, a high conductivity and a high bending fatigue resistance are required.

Background

There is a need for wire rods for micro speakers or magnet wires or ultra-fine coaxial cables having a high tensile strength to withstand a tension in the manufacturing process of a wire rod or in coil forming, a high flexibility that allows flexible bending, coil forming, and the like, a high conductivity that allows more electricity to flow, as well as a high bending fatigue to withstand repeated bending, folding, or the like at the same time. Due to recent downsizing of electronic equipment, diameters of wire rods are becoming ever smaller, and thus the aforementioned needs are becoming ever higher.

As the wire rods described above, conventionally, there are cases where silver-containing copper alloy wires are used. The reason is that silver added to copper emerges as a crystallized/precipitated product and has an effect of improving strength, and, although in general, conductivity decreases when an additive element is dissolved into copper, silver has a property that the reduction in conductivity is small even when added to copper. Known until now are a Cu—Ag alloy wire in which an area ratio of crystallized/precipitated products each having a maximum length of straight lines cutting each of the crystallized/precipitated products of less than or equal to 100 nm is 100% (Japanese Patent No. 5713230), and a copper alloy wire in which, for wire diameter d, a distance between the closest crystallized/precipitated product phases is greater than or equal to d/1000 but less than or equal to d/100, and a ratio of the number of crystallized/precipitated products having a crystallized/precipitated product phase with a size greater than or equal to d/5000 but less than or equal to d/1000 to the total number of the crystallized/precipitated products is greater than or equal to 80% (described in Japanese Patent Application No. 2015-114320).

The conventional techniques, however, are not capable of sufficiently satisfying the needs described above. The reasons are that wire rods work-hardened by wire drawing or the like to improve the tensile strength and the bending fatigue resistance fails to satisfy the flexibility, while wire rods heat-treated to improve the flexibility fail to satisfy the requirements due to reduction in the tensile strength and the bending fatigue resistance, particularly due to a significant reduction in the bending fatigue resistance. Furthermore, even if precipitation strengthening or dispersion strengthening of crystallized/precipitated products is performed to compensate for the reduction described above, the requirements for the bending fatigue resistance is still not sufficiently satisfied. For example, the copper alloy wire described in Japanese Patent No. 5713230 fails to satisfy the requirement for the flexibility, and the copper alloy wire described in Japanese Patent Application No. 2015-114320 fails to satisfy either the requirements for the flexibility or the bending fatigue resistance.

The present disclosure is related to providing a copper alloy wire rod having a high tensile strength, a high flexibility, a high conductivity and a high bending fatigue resistance at the same time.

SUMMARY

The present inventors carried out assiduous studies on the relation between the high bending fatigue resistance and the crystallized/precipitated products, and as a result, reached the findings that the bending fatigue resistance, in particular, of even a wire rod heat-treated for the purpose of providing flexibility can be improved by controlling the particle shape of second phase particles derived from crystallized/precipitated products to a predetermined relation, and the present disclosure has been accomplished based on such findings.

According to an aspect of the present disclosure, a copper alloy wire rod has a chemical composition comprising or consisting of: Ag: 0.1 to 6.0 mass % and P: 0 to 20 mass ppm, the balance being copper with inevitable impurities, in a cross section parallel to a longitudinal direction of the wire rod, a number density of second phase particles having an aspect ratio of greater than or equal to 1.5 and a size in a direction perpendicular to the longitudinal direction of the wire rod of less than or equal to 200 nm being greater than or equal to 1.4 particles/$\mu m^2$.

The copper alloy wire rod according to the aspect of the present disclosure, wherein, in the chemical composition, P: 0.1 to 20 mass ppm.

The copper alloy wire rod according to the aspect of the present disclosure, having a wire diameter of less than or equal to 0.15 mm.

The copper alloy wire rod according to the aspect of the present disclosure, wherein a number of bending cycles to fracture is greater than or equal to 4000 in a bending fatigue test in which a bending strain applied to an outer periphery of the wire rod is 1%.

The copper alloy wire rod according to the aspect of the present disclosure, having a tensile strength of greater than or equal to 320 MPa, an elongation of greater than or equal to 5%, and a conductivity of greater than or equal to 80% IACS.

According to the present disclosure, a copper alloy wire rod having a high tensile strength, a high flexibility, a high conductivity and a high bending fatigue resistance at the same time can be obtained.

DETAILED DESCRIPTION

Figure 1A:
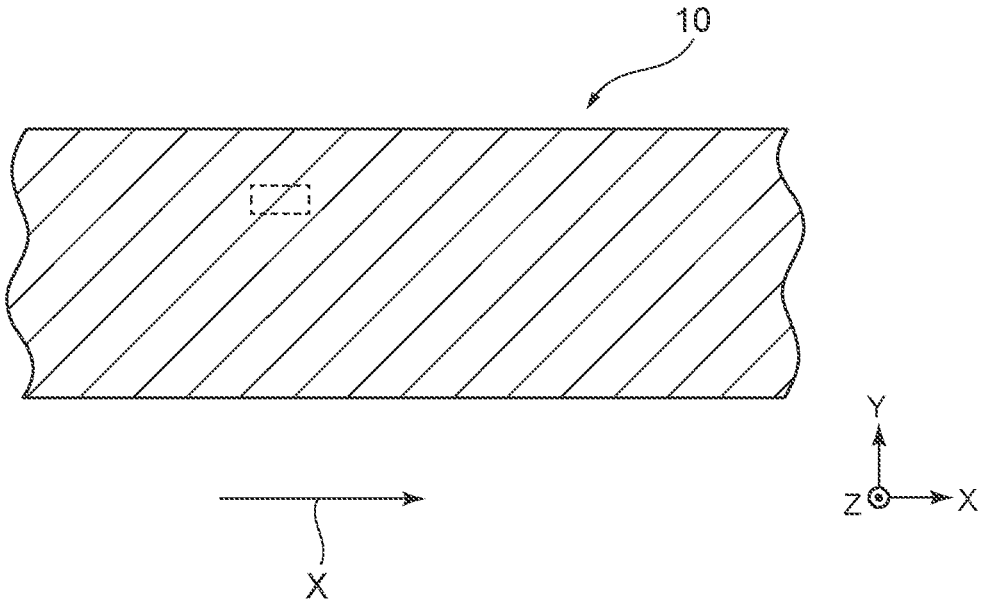
FIG. 1A is a schematic view illustrating a cross section parallel to the longitudinal direction of a copper alloy wire rod of the present disclosure.

Hereinafter, reasons for limitations on the chemical composition and the like of the present disclosure will be described.

(1) Chemical Composition

<Ag: 0.1 to 6.0 Mass %>

Ag (silver) is an element that exists in a solid-solution state in a copper matrix, or in a state as second phase particles crystallized in the casting or in a state as second phase particles precipitated during heat treatment after casting (in the present specification, these are collectively called as crystallized/precipitated products). In other words, Ag is an element having an effect of solid solution strengthening or dispersion strengthening. The second phase means a crystal having a crystal structure different from that of the matrix phase having a high copper content (first phase). In the present disclosure, the second phase has a high silver content. With an Ag content of less than 0.1 mass %, the aforementioned effect is insufficient, and the tensile strength and the bending fatigue resistance are inferior. With an Ag content of greater than 6.0 mass %, the conductivity decreases and the raw material cost increases. Therefore, from the viewpoint of maintaining a high strength and a high conductivity, the Ag content is 0.1 to 6.0 mass %. Although requirements for the strength and the conductivity are different depending on various uses, a balance between the strength and the conductivity can be adjusted by changing the Ag content. So as to satisfy all the characteristics required in recent years, the Ag content of 1.4 to 4.5 mass % is preferable considering a balance between the strength and the conductivity. In the present specification, a crystal containing a large amount of silver and having a crystal structure different from the matrix phase that emerges during solidification in casting is referred to as a crystallized product. A crystal containing a large amount of silver and having a crystal structure different from the matrix phase that emerges during cooling in casting or during heat treatment after casting is referred to as a precipitated product. A crystal containing a large amount of silver and having a crystal structure different from the matrix phase that has precipitated or dispersed in the final heat treatment is referred to as a second phase. The second phase particles mean particles comprising the second phase.

The copper alloy wire rod of the present disclosure contains Ag as an essential component as described above, and P (phosphorus) may be added thereto as needed.

<P: 0.1 to 20 Mass Ppm>

Molten copper usually contains oxygen mixed therein, so that the elongation of a copper alloy wire rod tends to be worsened. Elongation is known as one of the indices of flexibility. P (phosphorus) is an element that has a function of removing oxygen from molten copper by reacting with oxygen in molten copper to produce a compound of phosphorus and oxygen. With a P content of less than 0.1 mass ppm, the aforementioned function is insufficient, and an effect of improving an elongation of a copper alloy wire rod is not sufficiently achieved. On the other hand, with the P content of greater than 20 mass ppm, the conductivity decreases. Therefore, from the viewpoint of maintaining an excellent effect of improving the elongation and the high conductivity, it is preferable that the P content is 0.1 to 20 mass ppm. Although the amount of P to be added varies depending on a required balance between elongation and conductivity, a range of, for example, 4 to 10 mass ppm is more preferred than a range of more than 10 mass ppm to 20 mass ppm, at which the reduction in conductivity is rather predominant.

<Balance: Cu and Inevitable Impurities>

The balance other than the components described above comprises Cu (copper) and inevitable impurities. The inevitable impurities as defined here mean impurities at a content level that may be inevitably contained in a manufacturing process. Since the inevitable impurities may cause reduction in the conductivity depending on the content, it is preferable to control the content of the inevitable impurities to a certain extent, taking the reduction in the conductivity into account. Examples of the components as inevitable impurities include Si, Mg, Al and Fe.

The copper alloy wire rod of the present disclosure can be obtained by controlling the manufacturing process in addition to adjustment of the chemical composition. Hereinafter, a preferred method for manufacturing the copper alloy wire rod of the present disclosure will be described.

(2) Method for Manufacturing the Copper Alloy Wire Rod in an Embodiment of the Present Disclosure The copper alloy wire rod in an embodiment of the present disclosure can be manufactured by successively performing each of the steps of: [1] melting, [2] casting, [4] wire drawing, and [5] final heat treatment. Note that a step of [3] selective heat treatment may be added before or in the step of [4] wire drawing as needed. Further, a step of plating, a step of applying enamel, a step of making a stranded wire, or a step of coating resin to make an electric wire may be provided after [5] final heat treatment step. Hereinafter, the steps [1] to [5] will be described.

[1] Melting

In the melting step, a material with an amount of each of the components being controlled to be the aforementioned chemical composition is prepared, and then melted.

[2] Casting

Casting is performed by an upcast continuous casting method. It is a manufacturing method of continuously obtaining a wire rod by drawing out a cast ingot wire rod at a certain interval. The cast ingot has a diameter of 10 mmφ. Preferably, during casting, the average cooling rate in a temperature range from 1085° C. to 780° C. is greater than or equal to 500° C./s, and the average cooling rate in a temperature range from 780° C. to 300° C. is less than or equal to 500° C./s. Since the size of the cast ingot has effects on crystal growth in a solidification process and on a degree of precipitation in a cooling process, the size can be appropriately changed to maintain the crystal growth and the degree of precipitation in certain ranges, and preferably a diameter of 8 mmφ to 12 mmφ.

The reason for controlling the average cooling rate in a temperature range from 1085° C. to 780° C. to be greater than or equal to 500° C./s is that by increasing a temperature gradient in solidification, fine columnar crystals are caused to appear and fine bubbles of $H_2O$ are caused to be dispersed at many grain boundaries. This makes it possible to obtain a material that is less likely to result in a wire break in wire drawing. On the other hand, with an average cooling rate in a temperature range from 1085° C. to 780° C. of less than 500° C./s, the temperature gradient tends to be smaller, so that equiaxed crystals are formed and the crystal grains tend to coarsen. As a result, since the crystal grains are large, bubbles cannot be dispersed and the possibility of a wire break in wire drawing increases. Also, in a case where an average cooling rate is greater than 1000° C./s in the temperature range from 1085° C. to 780° C., the cooling is too fast and the replenishment of the melt cannot catch up. This results in a material including voids inside the cast ingot wire rod, and this also results in an increased possibility of a wire break in wire drawing. Note that 1085° C. is the melting point of pure copper, and 780° C. is the eutectic temperature of a copper-silver alloy.

The reason for controlling the average cooling rate in the temperature range from 780° C. to 300° C. to be less than or equal to 500° C./s is to obtain an effect of improving the tensile strength and the bending fatigue resistance obtained by causing the precipitation of silver-containing precipitated products during cooling. The precipitates that have precipitated during the cooling are drawn into a fibrous form in the subsequent wire drawing step. By applying a further heat treatment for a short time, silver atoms are rearranged and dispersed starting from locations of the existing precipitated products in a fibrous form, so that fine second phase particles having a high aspect ratio can be obtained. With an average cooling rate in the temperature range from 780° C. to 300° C. being greater than 500° C./s, the precipitation of the second phase particles is insufficient, so that the tensile strength and the bending fatigue resistance cannot be sufficiently obtained. Note that, similarly, the crystallized products that are crystallized during solidification also become crystallized products in a fibrous form after wire drawing and change into second phase particles having a high aspect ratio by a subsequent heat treatment, and contribute to improvements the tensile strength and the bending fatigue resistance. In the present disclosure, the second phase particles derived from the precipitated products that have precipitated through control of the cooling rate are added to the second phase particles derived from the crystallized products that have crystallized during solidification, so that the tensile strength and the bending fatigue resistance can be further improved.

The cooling rate during the aforementioned casting was measured by setting, in a mold, a seed wire having a diameter of about 10 mm with an R thermocouple embedded at the beginning of casting, and recording the change in temperature when the seed wire was drawn out. The R thermocouple was embedded at the center of the seed wire. The drawing out was initiated from a state in which the tip of the R thermocouple was immersed straight into the melt.

[3] Selective Heat Treatment

Next, it is preferable to perform a selective heat treatment on the cast ingot wire rod obtained by casting as needed. By selectively performing a heat treatment under the following conditions, more precipitated products containing silver can be precipitated. The timing of the heat treatment is preferably close to immediately after casting and most preferably immediately after casting, such that sufficient wire drawing can be performed after the heat treatment and the precipitated products becomes a more distinctive fibrous form (elongated in the longitudinal direction of the wire rod). The heat treatment temperature in the selective heat treatment is 300 to 700° C. In a case where the heat treatment temperature in the selective heat treatment is lower than 300° C., no precipitated products precipitate or precipitated products precipitate in an ultrafine state, so that even if the precipitated product become a fibrous form after wire drawing, the size of the precipitated products is not ensured and second phase particles having a high aspect ratio cannot be obtained in the subsequent heat treatment, thus resulting in an insufficient bending fatigue resistance. In a case where a heat treatment temperature in the selective heat treatment is higher than 700° C., most of silver dissolves in copper, so that almost no precipitated products in a fibrous form are present after wire drawing, and almost no second phase particles having a high aspect ratio can be obtained in the subsequent heat treatment, resulting in an insufficient bending fatigue resistance. Also, from the viewpoint of increasing a precipitation amount and increasing the precipitation size of the precipitated products, a heat treatment temperature in the selective heat treatment is preferably 350 to 500° C. Since the precipitation size depends on the treatment temperature and the retention time, in order to maintain the precipitation size and the precipitation amount at a certain temperature, it is preferable to have a retention time of 1 hour, and perform quenching. The quenching is performed by immersing the wire rod in water.

[4] Wire Drawing

Subsequently, the cast ingot wire rod obtained by casting or the wire rod subjected to selective heat treatment is subjected to wire drawing to reduce the diameter. Wire drawing has an effect of stretching the crystallized/precipitated products in a drawing direction, and crystallized/precipitated products having a fibrous form can be obtained. In order that the crystallized/precipitated products having a fibrous form appear inside the wire rod without being unevenly distributed, it is required to design a pass schedule such that the inside and the outside of the wire are evenly drawn. With a one-pass die, the working ratio (cross section reduction ratio) is 10 to 30%. With a working ratio of less than 10%, a shearing stress of the die concentrates at a surface of the wire rod, and thus the surface of the wire rod is preferentially drawn in wire drawing. This results in a phenomenon that more crystallized/precipitated products in a fibrous form are distributed at the surface of the wire rod, while relatively less crystallized/precipitated products are distributed in the vicinity of the center of the wire rod. Consequently, uneven distribution of the second phase particles having a high aspect ratio after the final heat treatment also occurs and sufficient bending fatigue resistance cannot be obtained. With a working ratio of greater than 30%, the drawing force needs to be increased and the possibility of wire break increases. It is preferable that the final wire diameter of the copper alloy wire rod of the present disclosure is less than or equal to 0.15 mm taking the recent requirement for reducing the diameter into consideration.

[5] Final Heat Treatment

Subsequently, the drawn wire rod is subjected to a heat treatment. The heat treatment is performed for dispersing the crystallized/precipitated products in a fibrous form that are formed in wire drawing to obtain second phase particles having a high aspect ratio. The retention time of the final heat treatment is preferably short, and the retention time is within 5 seconds. This is because with a heat treatment time of more than 5 seconds, the crystallized/precipitated products in a fibrous form disperse excessively and change into spherical second phase particles. Such short-time heat treatment facilities employ, for example, a current heat treatment in which an electric current is passed through the wire rod to generate Joule heat for the heat treatment, or a travelling heat treatment in which the wire is continuously passed through a heated furnace for applying heat treatment. The heat treatment temperature is also important for the crystallized/precipitated products in a fibrous form to be dispersed in the second phase particles having a high aspect ratio. The heat treatment temperature in the final heat treatment is 500° C. to 800° C. With a heat treatment temperature in the final heat treatment of lower than 500° C., removal of the strain in processing, which is another objective of the heat treatment, cannot be achieved in a short time of 5 seconds. Accordingly, a sufficient flexibility cannot be obtained. With a heat treatment temperature in the final heat treatment of higher than 800° C., the crystallized/precipitated products in a fibrous form excessively disperse and change into spherical second phase particles (an aspect ratio of approximately 1).

(3) Texture Characteristics of the Copper Alloy Wire Rod of the Present Disclosure The copper alloy wire rod according to the present disclosure having the chemical composition described in (1) and manufactured by the manufacturing method described in (2) is characterized in that, in a cross section parallel to a longitudinal direction of the wire rod, a number density of second phase particles having an aspect ratio of greater than or equal to 1.5 and a size in the direction perpendicular to the longitudinal direction of the wire rod of less than or equal to 200 nm is greater than or equal to 1.4 particles/$\mu m^2$. Note that the longitudinal direction of the wire rod corresponds to the direction of wire drawing in manufacturing the wire rod.

According to the copper alloy wire rod of the present disclosure, the bonding between the matrix phase and the second phase particles is further strengthened by the dispersion of second phase particles, and thus an increase in an area of an interface between the second phase particles and the matrix phase further improves the bending fatigue resistance. The second phase particles, however, are crystalline particles mostly composed of silver and are softer than the matrix phase of copper. As a result, simply making the second phase particles excessively large causes a stress to concentrate on the second phase particles when a bending fatigue is applied, resulting in a deformation of the second phase particles themselves and worsen the bending fatigue resistance. Accordingly, there is a method in which the second phase particles are made smaller to prevent deformation and the number density is increased to increase an area of the interface between the second phase particles and the matrix phase, and, according to the present disclosure, the aspect ratio of the second phase particles is greater than or equal to 1.5 to further increase an area of the interface. In bending fatigue, tensile and compressive stresses are applied in the longitudinal direction of the wire rod, and thus individual second phase particles having smaller areas in the cross section perpendicular to the longitudinal direction of the wire rod result in a smaller deformation and does not worsen the bending fatigue resistance. In contrast, in a cross section parallel to the longitudinal direction of the wire rod, as the length of individual second phase particles increases, the bending fatigue resistance is more improved due to an increase in an area of the interface. It is therefore conceivable that when a number density of the second phase particles having an aspect ratio of greater than or equal to 1.5 and a size in the direction perpendicular to the longitudinal direction of the wire rod of less than or equal to 200 nm is greater than or equal to 1.4 particles/$\mu m^2$, the bending fatigue resistance is particularly excellent. In particular, the number density of the second phase particles having an aspect ratio of greater than or equal to 1.5 and a size in the direction perpendicular to the longitudinal direction of the wire rod of less than or equal to 200 nm is preferably 1.7 to 3.0 particles/$\mu m^2$, and more preferably 2.0 to 3.0 particles/$m^2$.

(4) Characteristics of the Copper Alloy Wire Rod of the Present Disclosure

The copper alloy wire rod of the present disclosure is excellent in bending fatigue resistance. For example, in a bending fatigue test using an apparatus shown in FIG. 2, under the condition in which a bending strain applied to an outer periphery of the wire rod is 1%, the number of bending cycles is preferably 1000 or more, more preferably 3000 or more, still more preferably 4000 or more, particularly preferably 5000 or more. The specific measurement conditions will described in the following Examples.

Further, a copper alloy wire rod is required to have a high tensile strength, such that the wire rod can withstand the tension in the wire rod manufacturing process or in a coil forming process. Therefore, the copper alloy wire rod of the present disclosure has a tensile strength (TS) in accordance with JIS Z2241 of preferably greater than or equal to 250 MPa, more preferably greater than or equal to 300 MPa, still more preferably greater than or equal to 320 MPa, particularly preferably greater than or equal to 350 MPa.

Further, it is desirable to be capable of being flexibly bent during a forming work in forming a coil for a micro speaker, and the wire rod to be capable of being easily handled in a current heat treatment and a travelling heat treatment, or in enamel coating. The copper alloy wire rod is therefore required to have a high flexibility, and it is desirable to have a high elongation as an index thereof. The elongation (%) in accordance with JIS Z2241 of the copper alloy wire rod of the present disclosure is therefore preferably greater than or equal to 5%, more preferably greater than or equal to 10%, still more preferably greater than or equal to 15%.

Further, a copper alloy wire rod is required to have a high conductivity in order to prevent generation of heat by Joule heating. It is therefore preferable for the copper alloy wire rod of the present disclosure to have a conductivity of greater than or equal to 80% IACS. Note that the specific measurement conditions are described in the following Examples.

The copper alloy wire rod of the present disclosure can be used as a copper alloy wire, a plated wire made by tin-plating the copper alloy wire, and a stranded wire obtained by twisting a plurality of copper alloy wires or plated wires, and further may be used as an enameled wire coated with an enamel or further as an electrical wire coated with a resin.

Embodiments of the present disclosure have been described above, but the present disclosure is not limited to the embodiments of the present disclosure described above, but includes various aspects within the concept of the present disclosure or claims and various modifications can be made within the scope of the present disclosure.

EXAMPLES

In order to further clarify the effect of the present disclosure, Examples and Comparative Examples will be described below, but the present disclosure is not limited to these Examples.

Examples 1 to 29 and Comparative Examples 1 to 7

Raw materials (oxygen-free copper, silver and phosphorus) were fed into a graphite crucible such that the component composition is as shown in Table 1, and an internal temperature of the crucible in the furnace was heated to 1250° C. or higher to melt the raw materials. Resistive heating was employed for the melting. As the atmosphere in the crucible, a nitrogen atmosphere was employed such that no oxygen mixes into copper melt. After maintaining the temperature at 1250° C. or higher for 3 hours or more, cast ingots having a diameter of about 10 mm were made by casting with a graphite mold while changing the cooling rate variously as shown in Table 1. The cooling rate was changed by controlling the water temperature and water quantity of a water-cooling apparatus. After initiation of casting, continuous casting was performed by appropriately feeding the raw materials.

Subsequently, each of the cast ingots was subjected to wire drawing at a working ratio of 19 to 26% per pass until a final wire diameter shown in Table 1 was obtained. The processed material after wire drawing was then subjected to a final heat treatment under conditions shown in Table 1 under a nitrogen atmosphere, so that a copper alloy wire rod was obtained. Note that the heat treatment was performed by a travelling heat treatment.

Example 30

In Example 30, a copper alloy wire rod was obtained in the same manner as in Example 28, except that prior to wire drawing, the cast ingot was subjected to a selective heat treatment at a heat treatment temperature of 500° C. and for a retention time of 1 hour under a nitrogen atmosphere and then cooled by water.

Example 31

In Example 31, a copper alloy wire rod was obtained in the same manner as in Example 30, except that the heat treatment temperature of the selective heat treatment was 600° C.

Comparative Example 8

In Comparative Example 8, a copper alloy wire rod was obtained in the same manner as in Example 26, except that the working ratio was 7 to 9% per pass in wire drawing.

Comparative Example 9

In Comparative Example 9, the raw materials were melted to obtain the composition shown in Table 1 in the same manner as in Examples described above. A cast ingot having a diameter of 8 mm was then made by casting under the casting conditions shown in Table 1. Subsequently, the cast ingot was subjected to heat treatment at a heat treatment temperature of 760° C. for a retention time of 2 hours under a nitrogen atmosphere, and quenched (solution heat treatment). After the heat treatment, the cast ingot was then subjected to wire drawing until a wire diameter of 0.9 mm. After the wire drawing, the processed material was further subjected to heat treatment at 450° C. for a retention time of 5 hours under a nitrogen atmosphere, and furnace-cooled. The processed material after the heat treatment was again subjected to wire drawing until a final wire diameter shown in Table 1 (0.04 mm) to obtain a copper alloy wire rod. Such copper alloy wire rod corresponds to sample Nos. 2-4 described in Japanese Patent No. 5713230.

Comparative Example 10

In Comparative Example 10, the raw materials were melted to obtain the composition shown in Table 1 in the same manner as in Examples described above. A cast ingot having a diameter of 8 mm was made by casting under the casting conditions shown in Table 1. The cast ingot was then subjected to wire drawing until a wire diameter of 2.6 mm. After the wire drawing, the processed material was further subjected to heat treatment at 450° C. for a retention time of 5 hours under a nitrogen atmosphere, and furnace-cooled. The processed material after the heat treatment was again subjected to wire drawing until the final wire diameter shown in Table 1 (0.04 mm) to obtain a copper alloy wire rod. Such copper alloy wire rod corresponds to sample Nos. 2-7 described in Japanese Patent No. 5713230.

Comparative Example 11

In Comparative Example 11, the surfaces of raw materials (copper and Ag) having a purity of 99.99 mass % were acid-washed with 20 vol % nitric acid. The raw materials were sufficiently dried and then fed into a graphite crucible, such that the composition is as shown in Table 1. Subsequently, the raw materials were melted by resistive heating at 1200° C. or higher and sufficiently stirred. The melt was maintained for 30 minutes and then continuously cast downward from the bottom of the crucible into a graphite mold under conditions with a cooling rate of 500° C./s, so that a cast ingot having a diameter of 20 mm was made by casting. The cast ingot was then subjected to wire drawing and peeling until a wire diameter of 0.2 mm. Thereafter, further, heat treatment at 600° C. for a retention time of 10 seconds was performed to obtain a copper alloy wire rod. Note that such copper alloy wire rod corresponds to Example 17 described in Japanese Patent Application No. 2015-114320.

(Evaluation)

The copper alloy wire rods in the Examples and Comparative Examples were subjected to the following measurements and evaluations. Each of the evaluation conditions are as follows. The results are shown in Table 1.

[Texture Observation]

Figure 3A:
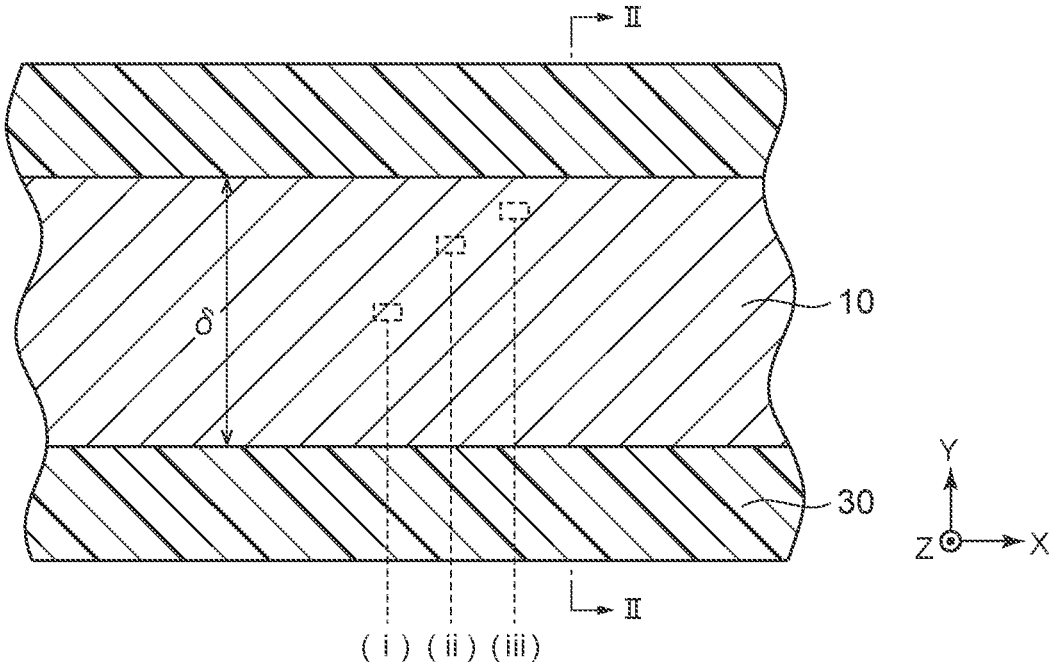
FIG. 3A is a schematic view illustrating a cross section parallel to the longitudinal direction of an observation sample embedded in a resin for texture observation in Examples (I-I surface in FIG. 3B)
Figure 3B:
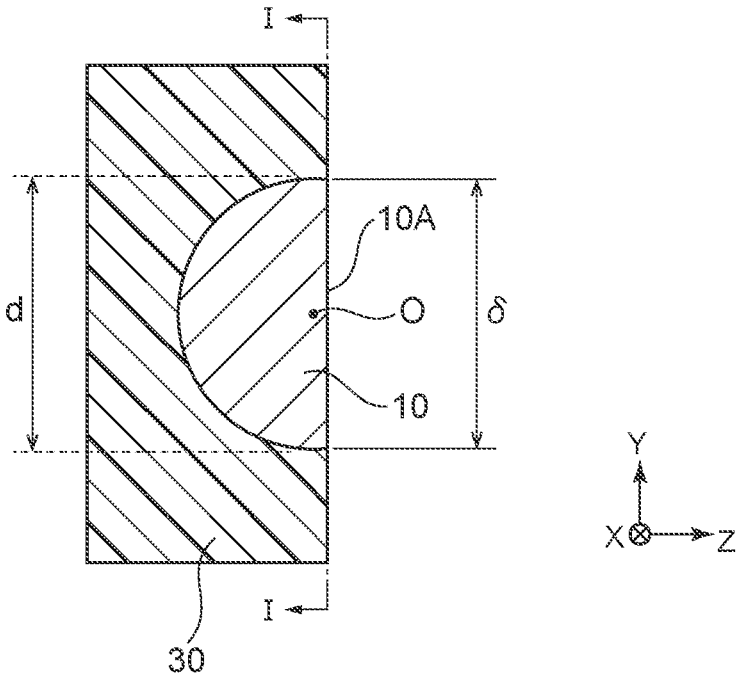
FIG. 3B is a schematic view illustrating a cross section perpendicular to the longitudinal direction of an observation sample embedded in a resin for observation (cross section taken along II-II in FIG. 3A).

The obtained wire rod was embedded in a resin 30 so as to be cut at a cross section parallel to the longitudinal direction X of the wire rod 10 as shown in FIG. 3A and the cross section was polished into a mirror finish surface 10A to make an observation sample. It is, however, practically difficult to process all of the wire rods such that the polished mirror finish surface passes perfectly through the center O of the wire rod. Therefore, the resin embedding and the polishing were performed such that the width δ of the polished cross section of the wire rod (length perpendicular to the longitudinal direction of the wire rod) was in the range of $\delta \geq 0.8d$, wherein d represents the diameter of the wire rod as shown in FIG. 3B.

Subsequently, a texture photograph of the mirror-finished cross section parallel to the longitudinal direction of the wire rod was taken at a magnification of 20000 with a scanning electron microscope (FE-SEM, manufactured by JEOL). For the texture photograph taken, three fields of view were observed: (i) a field of view including a central part of the mirror-finished cross section parallel to the longitudinal direction of the wire rod, (ii) a field of view including a part which is δ/4 apart from the center of the cross section in the direction perpendicular to the longitudinal direction of the wire rod, wherein δ represents the width of the polished cross section of the wire rod, and (iii) a field of view including a part which is 3δ/8 apart from the center of the cross section in a direction perpendicular to the longitudinal direction of the wire rod. The observation range in each of the fields of view was 3 m×4 μm, and overlapped range was not observed. Since it is very time-consuming to accurately select the positions of (i), (ii) and (iii), a separation distance between (i) and (ii) or between (ii) and (iii) of greater than or equal to δ/8 from the center of the cross section in the direction perpendicular to the longitudinal direction of the wire rod, was deemed to be acceptable.

Figure 1B:
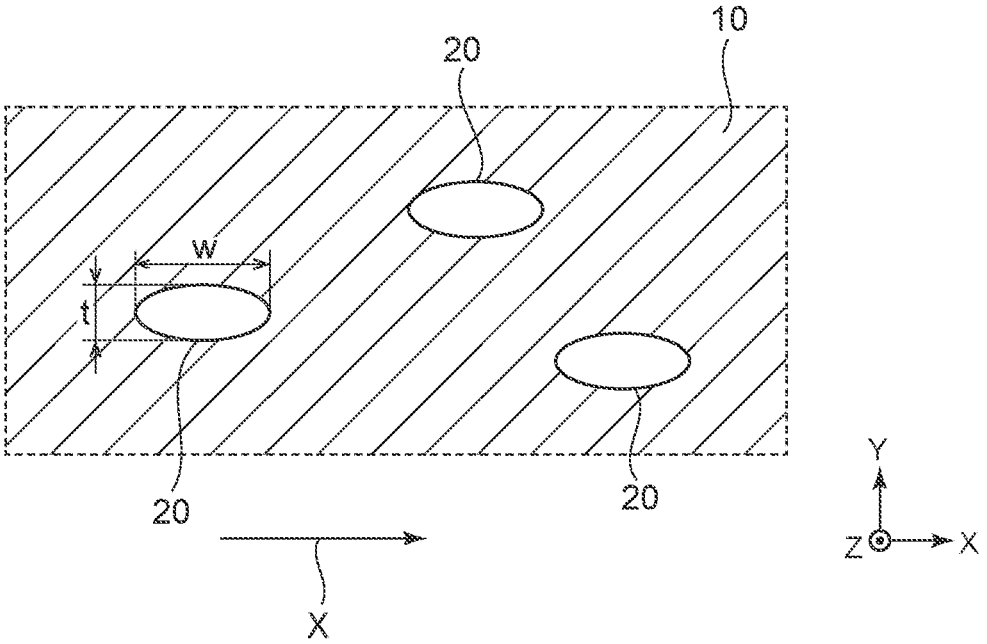
FIG. 1B is an enlarged schematic view of a portion framed by broken lines illustrated in FIG. 1A.

In the photographed image, regions observed whiter than the surroundings were determined as second phase particles 20 containing a large amount of silver (see FIG. 1B), and the number thereof was counted. Further, for each of the second phase particles, each of size w in the longitudinal direction of the wire rod and size t in a direction perpendicular to the said direction were measured. From the measured values, the aspect ratio of the second phase particles (ratio of size w in a longitudinal direction of wire rod/size t in a direction perpendicular to the direction) was calculated to count the number of the second phase particles having an aspect ratio of greater than or equal to 1.5 and a size t in the direction perpendicular to the longitudinal direction of the wire rod of less than or equal to 200 nm (hereinafter, also referred to as "specific second phase particles"). The measurement was performed in the same manner for the three fields of view so as to calculate the number density of the second phase particles having an aspect ratio of greater than or equal to 1.5 and a size in the direction perpendicular to the longitudinal direction of the wire rod of less than or equal to 200 nm (specific second phase particles), by dividing the total number of the specific second phase particles by the total area of observed fields of view (3 μm×4 μm×3 fields of view).

Figure 2:
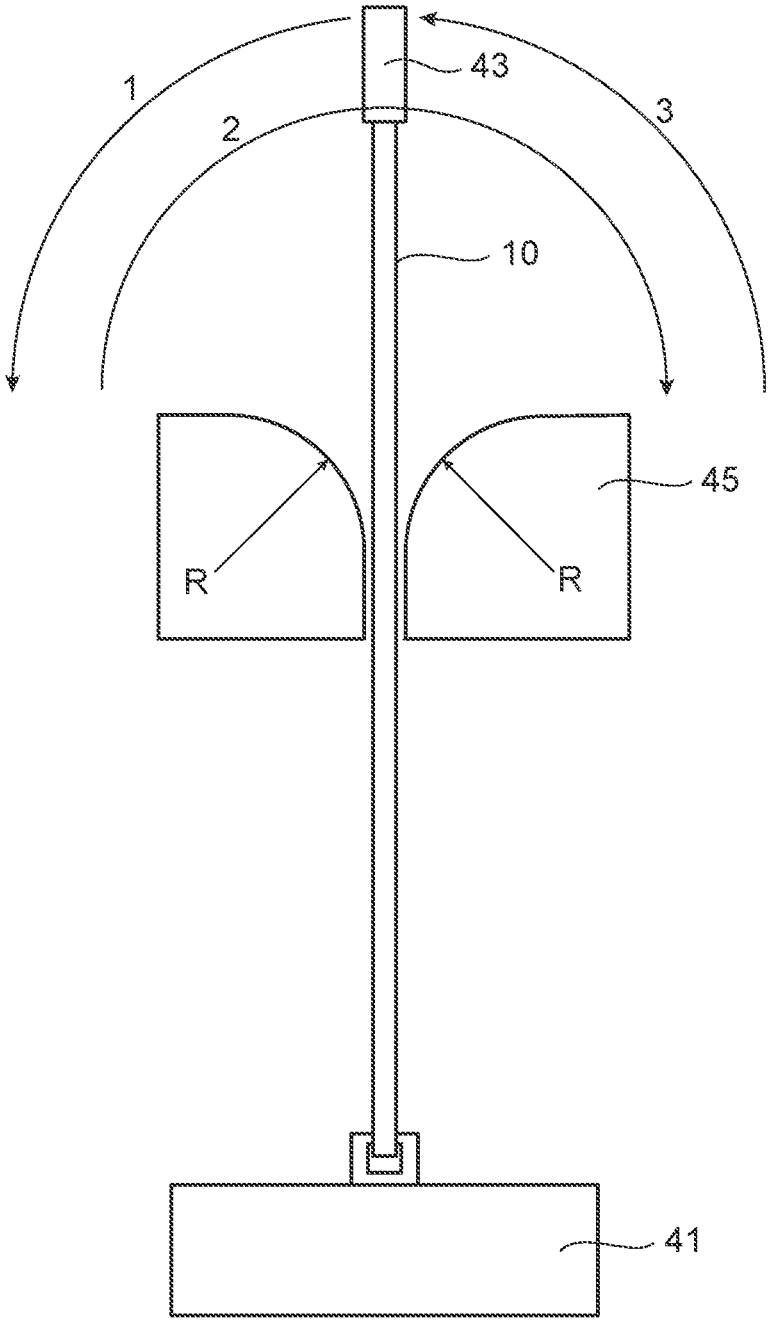
FIG. 2 is a schematic view of a testing machine used in a bending fatigue test in Examples.

[Bending fatigue resistance]A bending fatigue resistance test was performed to measure the number of bending cycles until fracture of the wire rod using a bending test machine shown in FIG. 2 (manufactured by Fujii Co., Ltd., formerly known as Fujii Seiki Company). Specifically, as shown in FIG. 2, using the obtained wire rod as a measurement sample, a weight 41 was hung from the bottom end of the sample to apply load in order to suppress deflection. Since the load induces a tensile stress in the wire rod, the load should be as small as possible, and not causing advantages or disadvantages depending on the wire diameter. Accordingly, in order to make the tensile stress induced by the load as constant as possible (23 to 31 MPa), the load of weight 41 was changed depending on the wire diameter. In other words, the weight 41 used was 130 g for a wire diameter of φ0.26 mm, 80 g for a diameter of φ0.2 mm, 20 g for a diameter of φ0.1 mm, 3 g for a diameter of φ0.04 mm, and 1 g for a diameter of φ0.02 mm. The top end portion of the sample was fixed with a connecting attachment 43. An arm whereto the connecting attachment 43 is attached in this state was subjected to repeated oscillating rotary movement by 90 degrees each to the right and left sides at a rate of 100 cycles per minute, so that a wire rod 10 was bent along the bending radius (R) of a jig 45. The number of bending cycles until fracture of the wire rod 10 was thus measured. Note that the number of bending cycles was counted in such a manner that one reciprocating motion "1→2→3" in FIG. 2 was counted as one cycle, and the fracture was determined to have occurred when the weight 41 hung from the bottom end portion of the sample fell off. The bending radius (R) was determined such that the bending strain (ε) applied to the outer periphery of the wire rod 10 is 1%. Note that the test was carried out with four wire rods each (N=4), and an average of the numbers of bending cycles until fracture of each of the wire rods was obtained. The larger number of bending cycles until fracture of a wire rod means the bending fatigue resistance is excellent. In the present Examples, the pass level was determined to be 1000 cycles or more.

[Tensile Strength]

A tension test was performed to measure the tensile strength (MPa) using a precision universal testing machine (manufactured by Shimadzu Corporation) in accordance with JIS Z2241. The test was carried out with three wire rods each (N=3), and the average thereof was obtained as the tensile strength of each of the wire rods. A larger tensile strength is more preferable, and in the present Examples, the pass level was determined to be greater than or equal to 250 MPa.

[Elongation]

The elongation (%) was calculated using a precision universal testing machine (manufactured by Shimadzu Corporation) in accordance with JIS Z2241. The test was carried out with three wire rods each (N=3), and the average thereof was obtained as the elongation of each of the wire rods. A larger elongation is more preferable, and in the present Examples, the pass level was determined to be greater than or equal to 5%.

[Conductivity]

In a thermostat chamber maintained at 20° C. (+0.5° C.), the resistances of three sample particles with a length of 300 mm were measured by a four terminal method and, further, the respective specific resistance values were obtained (N=3). Based on the average thereof, the conductivity (% IACS) of each of the wire rods were calculated. The distance between the terminals was 200 mm. A higher conductivity is the more preferable, and in the present Examples, the pass level was determined to be greater than or equal to 80% IACS.

TABLE 1

| | | Composition | | | Manufacturing conditions | | | | | Texture evaluation | Evaluation on characteristics | | | |
|---|---|---|---|---|---|---|---|---|---|---|---|---|---|---|
| | | | | | Casting | | | Final heat treatment | | Number density of | | | | Bending fatigue properties (c = 1%) |
| No. | | Ag mass % | P mass ppm | Cu and inevitable impurities | Average cooling rate from 1095° C. to 780° C. ° C./s | Average cooling rate from 780° C. to 300° C. ° C./s | Wire drawing Final wire diameter mm | Heat treatment temperature ° C. | Retention time — | specific second phase particles particles/μm² | Tensile strength MPa | Elongation % | Conductivity % IACS | Number of cycles |
| Example | 1 | 4.0 | 6.0 | Balance | 600 | 50 | 0.1 | 600 | 2 s | 2.0 | 348 | 15 | 86 | 5420 |
| | 2 | 4.0 | 6.0 | Balance | 600 | 50 | 0.1 | 600 | 2 s | 2.3 | 354 | 14 | 86 | 5510 |
| | 3 | 4.0 | 6.0 | Balance | 600 | 500 | 0.1 | 600 | 2 s | 2.2 | 363 | 18 | 86 | 5140 |

TABLE 1-continued

| | | Composition | | | Manufacturing conditions: Casting | | | Final heat treatment | | Texture evaluation | Evaluation on characteristics | | | |
|---|---|---|---|---|---|---|---|---|---|---|---|---|---|---|
| | No. | Ag mass % | P mass ppm | Cu and inevitable impurities | Average cooling rate from 1095° C. to 780° C. ° C./s | Average cooling rate from 780° C. to 300° C. ° C./s | Wire drawing Final wire diameter mm | Heat treatment temperature ° C. | Retention time — | Number density of specific second phase particles particles/μm² | Tensile strength MPa | Elongation % | Conductivity % IACS | Bending fatigue properties (c = 1%) Number of cycles |
| | 4 | 4.0 | 6.0 | Balance | 600 | 250 | 0.1 | 600 | 2 s | 2.2 | 355 | 16 | 86 | 5200 |
| | 5 | 4.0 | 6.0 | Balance | 600 | 50 | 0.1 | 600 | 2 s | 2.0 | 387 | 6 | 88 | 6570 |
| | 6 | 1.5 | 6.0 | Balance | 600 | 50 | 0.1 | 600 | 2 s | 1.6 | 302 | 23 | 93 | 2350 |
| | 7 | 3.5 | — | Balance | 600 | 50 | 0.1 | 600 | 2 s | 1.9 | 348 | 7 | 97 | 4980 |
| | 8 | 3.5 | 6.0 | Balance | 600 | 50 | 0.1 | 600 | 2 s | 1.9 | 345 | 18 | 88 | 4920 |
| | 9 | 3.5 | 6.0 | Balance | 600 | 50 | 0.04 | 600 | 1 s | 4.3 | 342 | 15 | 88 | 4880 |
| | 10 | 4.0 | — | Balance | 600 | 50 | 0.1 | 600 | 2 s | 2.0 | 355 | 12 | 86 | 5600 |
| | 11 | 4.0 | 6.0 | Balance | 600 | 50 | 0.1 | 600 | 2 s | 2.4 | 355 | 13 | 84 | 5500 |
| | 12 | 4.0 | 6.0 | Balance | 600 | 50 | 0.04 | 600 | 1 s | 3.7 | 356 | 13 | 84 | 5440 |
| | 13 | 5.0 | 6.0 | Balance | 600 | 50 | 0.1 | 600 | 2 s | 2.7 | 367 | 11 | 82 | 5480 |
| | 14 | 5.0 | 6.0 | Balance | 600 | 50 | 0.04 | 600 | 1 s | 3.6 | 361 | 10 | 83 | 5700 |
| | 15 | 6.0 | — | Balance | 600 | 50 | 0.1 | 600 | 2 s | 3.0 | 386 | 5 | 81 | 5660 |
| | 16 | 6.0 | 6.0 | Balance | 600 | 50 | 0.1 | 600 | 2 s | 3.0 | 382 | 10 | 80 | 5820 |
| | 17 | 4.0 | 1.0 | Balance | 600 | 50 | 0.1 | 600 | 5 s | 2.3 | 355 | 11 | 86 | 5790 |
| | 18 | 4.0 | 6.0 | Balance | 600 | 50 | 0.26 | 600 | 5 s | 1.4 | 354 | 16 | 86 | 5500 |
| | 19 | 4.0 | 6.0 | Balance | 600 | 50 | 0.1 | 600 | 2 s | 2.4 | 354 | 16 | 86 | 5480 |
| | 20 | 4.0 | 6.0 | Balance | 600 | 50 | 0.02 | 600 | 1 s | 8.1 | 326 | 15 | 85 | 5430 |
| | 21 | 4.0 | 12.0 | Balance | 600 | 50 | 0.1 | 600 | 2 s | 2.5 | 351 | 18 | 84 | 5310 |
| | 22 | 4.0 | 6.0 | Balance | 600 | 50 | 0.1 | 700 | 2 s | 1.7 | 336 | 18 | 85 | 5360 |
| | 23 | 0.5 | 6.0 | Balance | 600 | 50 | 0.1 | 500 | 5 s | 1.4 | 287 | 20 | 94 | 4220 |
| | 24 | 1.5 | — | Balance | 600 | 50 | 0.1 | 500 | 5 s | 1.6 | 313 | 18 | 93 | 1410 |
| | 25 | 1.5 | 6.0 | Balance | 600 | 50 | 0.1 | 500 | 5 s | 1.6 | 310 | 20 | 92 | 2580 |
| | 26 | 4.0 | 6.0 | Balance | 600 | 50 | 0.1 | 500 | 5 s | 2.3 | 376 | 11 | 86 | 2330 |
| | 27 | 5.0 | 6.0 | Balance | 600 | 50 | 0.1 | 500 | 5 s | 3.0 | 388 | 8 | 86 | 5760 |
| | 28 | 4.0 | 6.0 | Balance | 600 | 50 | 0.1 | 600 | 5 s | 2.4 | 341 | 15 | 85 | 6080 |
| | 29 | 4.0 | 6.0 | Balance | 600 | 50 | 0.1 | 700 | 5 s | 1.7 | 322 | 18 | 84 | 5200 |
| | 30 | 4.0 | 6.0 | Balance | 600 | 50 | 0.1 | 600 | 5 s | 2.6 | 368 | 16 | 86 | 4140 |
| | 31 | 4.0 | 6.0 | Balance | 600 | 50 | 0.1 | 600 | 5 s | 2.0 | 354 | 15 | 86 | 6020 |
| Comparative Example | 1 | **10.0** | 6.0 | Balance | 600 | 50 | 0.1 | 500 | 5 s | 5.6 | 480 | **2** | **76** | 5810 |
| | 2 | 4.0 | **30.0** | Balance | 600 | 50 | 0.1 | 500 | 5 s | 2.3 | 346 | 18 | **78** | 5210 |
| | 3 | — | — | Balance | 600 | 50 | 0.1 | 500 | 5 s | **0.0** | **237** | 20 | 98 | **780** |
| | 4 | 4.0 | 6.0 | Balance | 600 | 600 | 0.1 | 500 | 5 s | **0.9** | 358 | 11 | 86 | **870** |
| | 5 | 4.0 | 6.0 | Balance | 600 | 50 | 0.1 | 600 | 30 min | **0.0** | 288 | 22 | 94 | **680** |
| | 6 | 4.0 | 6.0 | Balance | 600 | 50 | 0.1 | 700 | 1 h | **0.0** | **156** | 6 | 90 | **151** |
| | 7 | 4.0 | 6.0 | Balance | 600 | 50 | 0.1 | — | — | **0.0** | 1034 | **2** | **77** | 10820 |
| | 8 | 4.0 | 6.0 | Balance | 600 | 50 | 0.1 | 500 | 5 s | **1.1** | 370 | 8 | 86 | **910** |
| | 9 | **10.0** | — | Balance | 0.2 | 50 | 0.04 | — | — | **0.0** | 1397 | **1** | **70** | 13200 |
| | 10 | 3.0 | — | Balance | 17 | 50 | 0.04 | — | — | **0.0** | 1304 | **1** | **74** | 12880 |
| | 11 | 3.0 | — | Balance | — | — | 0.1 | 600 | 10 s | **0.1** | 393 | 13 | 85 | **326** |

(Note 1)

The underlined bold letters in the table represent those outside the proper range of the present invention, or those having evaluation results not achieving the pass level of the present invention.

(Note 2)

Specific second phase particles mean those having in a cross section parallel of the longitudinal direction of a wire rod, an aspect ratio of greater than or equal to 1.5 and a size in a direction perpendicular to the longitudinal direction of the wire rod of less than or equal to 200 nm.

As shown in the results in Table 1, each of the copper alloy wire rods in Examples 1 to 31 of the present disclosure had a predetermined composition, and, in the cross section parallel to the longitudinal direction of the wire rod, second phase particles having an aspect ratio of greater than or equal to 1.5 and a size in the direction perpendicular to the longitudinal direction of the wire rod of less than or equal to 200 nm had a number density controlled to be 1.4 particles/μm² or more. It was confirmed that the wire rod exhibited a high tensile strength, a high flexibility (elongation), a high conductivity and a high bending fatigue resistance.

In contrast, each of the copper alloy wire rods in Comparative Examples 1 to 11 did not have the predetermined composition, and, in the cross section parallel to the longitudinal direction of the wire rod, second phase particles having an aspect ratio of greater than or equal to 1.5 and a size in the direction perpendicular to the longitudinal direction of the wire rod of less than or equal to 200 nm had a number density which is not controlled to be greater than or equal to 1.4 particles/μm². As a result, it was confirmed that at least one of the tensile strength, the flexibility (elongation), the conductivity and the bending fatigue resistance was inferior as compared to the copper alloy wire rods in Examples 1 to 31 of the present disclosure.

What is claimed is:

1. A copper alloy wire rod having a chemical composition comprising Ag: 0.1 to 6.0 mass % and P: 0 to 20 mass ppm, the balance being copper with inevitable impurities, in a cross section parallel to a longitudinal direction of the wire rod, a number density of second phase particles each having an aspect ratio of greater than or equal to 1.5 and a size in a direction perpendicular to the longitudinal direction of the wire rod of less than or equal to 200 nm being greater than or equal to 1.4 particles/$\mu m^2$.

2. The copper alloy wire rod according to claim 1, wherein, in the chemical composition, P: 0.1 to 20 mass ppm.

3. The copper alloy wire rod according to claim 1, having a wire diameter of less than or equal to 0.15 mm.

4. The copper alloy wire rod according to claim 1, wherein a number of bending cycles to fracture of greater than or equal to 4000 in a bending fatigue test in which a bending strain applied to an outer periphery of the wire rod is 1%.

5. The copper alloy wire rod according to claim 1, having a tensile strength of greater than or equal to 320 MPa, an elongation of greater than or equal to 5%, and a conductivity of greater than or equal to 80% IACS.

* * * * *